US006997723B2

(12) United States Patent
Lee

(10) Patent No.: US 6,997,723 B2
(45) Date of Patent: Feb. 14, 2006

(54) POWER INLET SOCKET

(75) Inventor: Seung-eon Lee, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/992,681

(22) Filed: Nov. 22, 2004

(65) Prior Publication Data

US 2005/0112919 A1 May 26, 2005

(30) Foreign Application Priority Data

Nov. 20, 2003 (KR) ..... 10-2003-0082466

(51) Int. Cl.
*H01R 13/648* (2006.01)

(52) U.S. Cl. ..... 439/92; 439/95; 439/106; 439/682; 439/692

(58) Field of Classification Search ..... 439/92, 439/95, 106, 107, 682, 692, 607, 79, 83
See application file for complete search history.

(56) References Cited

U.S. PATENT DOCUMENTS 5,466,175 A * 11/1995 Onoda ..... 439/610
6,386,918 B1 * 5/2002 Zheng et al. ..... 439/607
6,398,587 B1 * 6/2002 Chen et al. ..... 439/607
2003/0040204 A1 * 2/2003 Chen et al. ..... 439/106

FOREIGN PATENT DOCUMENTS

| | | |
|---|---|---|
| JP | 06-020746 A | 1/1994 |
| JP | 08-130052 A | 5/1996 |
| JP | 2000-040543 A | 2/2000 |
| KR | 20-0275350 | 4/2002 |

* cited by examiner

*Primary Examiner*—Tho D. Ta
(74) *Attorney, Agent, or Firm*—Sughrue Mion, PLLC

(57) ABSTRACT

A power inlet socket includes a socket body; live and neutral terminals provided on the socket body, and each having a first pin connected to the power plug and a second pin soldered on the substrate. A ground terminal is provided between the live terminal and the neutral terminal of the socket body; and a ground member is connected to the ground terminal and soldered on the substrate at opposite sides of the socket body. The socket body has a cavity formed with a bottom wall, opposite side walls, a top wall, and a rear wall, and which is open at one side thereof. The ground member is structured to connect the ground terminal at the rear wall and is forked so as to branch from the connection to the ground terminal to surround the upper wall and the opposite side walls.

21 Claims, 4 Drawing Sheets

POWER INLET SOCKET

This application claims benefit under 35 U.S.C. § 119 from Korean Patent Application No. 2003-82466, filed on Nov. 20, 2003, the entire content of which is incorporated herein by reference.

BACKGROUND OF THE INVENTION

1. Field of the Invention

Apparatuses consistent with the present invention relate to a power supply device for household information appliances such as monitors, and more particularly to a power inlet socket provided on a substrate of a power supply device that is externally connected to a power plug.

2. Description of the Related Art

A power supply device for household information appliances has a power inlet socket to which a power plug is externally connected. Such a power inlet socket is provided on the substrate of the power supply device, and FIG. 1A and FIG. 1B are views for showing the power supply device for monitors by way of example.

In FIGS. 1A and 1B, a reference number 1 denotes a substrate, and a reference number 2 denotes a power inlet socket. As shown in FIGS. 1A and 1B, the power inlet socket 2 has a socket body 3 and a plurality of terminals 4, 5, and 6.

The socket body 3 has a cavity formed therein, defined within a bottom wall, two opposite side walls, a top wall, and a rear wall. A pair of fixture hooks 3*a* are formed on the bottom wall and inserted into a pair of hook openings 1*a* formed on the substrate 1 so as to be mounted on the substrate 1.

Of the plurality of terminals 4, 5 and 6, one is a live terminal 4, another is a neutral terminal 5, and the other is a ground terminal 6. The terminals 4, 5, and 6 are provided with first pins 4*a*, 5*a*, and 6*a* and second pins 4*b*, 5*b*, and 6*b*, respectively. The first pins 4*a*, 5*a*, and 6*a* and the second pins 4*b*, 5*b*, and 6*b* are connected vertical to one another through openings (not shown) formed in the rear wall of the socket body 3.

As shown in FIG. 1A, the first pins 4*a*, 5*a*, and 6*a* are disposed to connect to a power plug (not shown) inserted into the cavity of the socket body 3, and, as shown in FIG. 1B, the second pins 4*b*, 5*b*, and 6*b* are disposed on the rear wall of the socket body 3, and the end portions of which are soldered on the substrate 1.

One end of the ground wire 7 is connected to the second pin 6*b* of the ground terminal 6, and the other end of which is soldered to the substrate 1, which can satisfy the stability of power supply and test conditions since overcurrent externally applied from the power plug passes through the ground terminal 6 and the ground wire 7.

However, the conventional power inlet socket with the above construction has the extra ground wire 7 in addition to the ground terminal 6 so as to stabilize the power supply and the strict standard for ground continuity test conditions, but has a problem of requiring an additional wire harness process for connecting the ground wire 7 to the ground terminal 6 and substrate 1.

Furthermore, the conventional power inlet socket uses the ground wire 7 which has a certain loop-like shape formed in a distance from the socket body and is soldered on the substrate, possibly causing a problem of contact or interference of the ground wire 7 with its neighboring parts on the substrate 1 due to movements of the ground wire 7.

Furthermore, the conventional power inlet socket has the ground terminal 6 disposed between the live terminal 4 and the neutral terminal 5 and the individual terminals are soldered on the substrate 1, which brings out difficulties in securing space for the terminals upon pattern design on the substrate since patterns for terminals are closely formed on the substrate 1. Also, the conventional substrate 1 has semicircular openings between terminal patterns in order to secure enough space between terminal patterns, which causes an inevitable cost increase due to additional work procedures.

SUMMARY OF THE INVENTION

The present invention has been developed in order to address the above drawbacks and other problems associated with the conventional arrangement. An aspect of the present invention is to provide a simplified power inlet socket that is easily mounted on a substrate as well as having ground characteristics to satisfy the more strictly enacted standard, that is, the ground continuity test conditions.

Another aspect of the present invention is to provide a power inlet socket that eliminates the use of a ground wire so as to reduce interference of the ground wire with other parts on the substrate.

Yet another aspect of the present invention is to provide a power inlet socket that facilitates designs of patterns on the substrate by securing adequate space between terminals.

It is contemplated that a non-limiting, exemplary embodiment of the present invention includes a power inlet socket mounted on a substrate for a power supply device of a household information appliance to externally connect to a power plug. Provided is a socket body for accommodating the power plug; and live and neutral terminals provided on the socket body, such that each has a first pin connected to the power plug and a second pin soldered on the substrate. Also provided is a ground terminal between the live terminal and the neutral terminal of the socket body; and a ground member connected to the ground terminal and soldered on the substrate at opposite sides of the socket body.

It is also contemplated that the socket body has a cavity formed with a bottom wall, opposite side walls, a top wall, and a rear wall, and open at one side thereof. The ground member is formed in a structure connected to the ground terminal at the rear wall and is forked so as to branch from the connection to the ground terminal to surround the upper wall and the opposite side walls.

Further, the ground terminal has a first pin connected to the power plug in the cavity of the socket body and a second pin disposed on the rear wall of the socket body to be connected vertical to the first pin. The second pin is disposed so as to not protrude below the bottom wall of the socket body nor be directly soldered to the substrate.

Thus, when the socket is mounted on the substrate with the ground member provided on the socket body to connect to the ground terminal, the live terminal and the neutral terminal are also mounted on the substrate, which eliminates additional wire harness work as in prior art. Further, because a ground terminal is not required to be soldered on the substrate between the live terminal and the neutral terminal, space between the live terminal and the neutral terminal can be secured so that an advantage is brought out in designing patterns on the substrate.

It is contemplated that the ground member is attached to the substrate at a position between the open side and the rear wall. Further, according to an exemplary embodiment, a distance between points where the ground member contacts the substrate is greater than a distance between points where the second pin of the live terminal and the second pin of the neutral terminal contact the substrate. In addition, portions of the opposite side walls of the socket body may be respectively slanted toward the top wall.

According to another exemplary embodiment of the present invention, a power inlet socket is contemplated that comprises a socket body having a cavity formed with a bottom wall, opposite side walls, a top wall, and a rear wall, open at one side thereof, and accommodating the power plug inserted therein. Live and neutral terminals are provided to each have a first pin disposed to connect to the power plug in the cavity of the socket body and a second pin disposed at the rear wall of the socket body, connected vertical to the first pin, and soldered on the substrate. A ground terminal is disposed between the live terminal and the neutral terminal of the socket body; and a ground member is connected to the ground terminal on the rear wall of the socket body, extended to surround the top wall and opposite side walls of the socket body, and having end portions thereof soldered on the substrate. Support parts for fixing the ground member at the opposite sides of the socket body may also be provided.

The ground terminal has a first pin connected to the power plug in the cavity of the socket body and a second pin disposed on the rear wall of the socket body to be connected vertical to the first pin. It is contemplated that the second pin does not protrude below the bottom wall of the socket body nor directly soldered.

The ground member support parts each have a pair of support ribs to form certain rails and are formed at the opposite sides of the socket body, and the ground member is accommodated in and supported by the rails.

Further, the ground member support parts each have a support block formed in a certain height at the opposite sides of the socket body and a support opening formed in the ground member to correspond to the support block. The support block may be formed outwardly slanted from an upper side to a lower side in a socket-mounting direction.

A pair of fixture hooks is formed with a certain distance therebetween in the middle portion of the bottom wall of the socket body, and a pair of hook openings is formed on the substrate in order for the pair of fixture hooks to be coupled therewith. The hook-coupled portions and the soldered portions of the ground member are located on a straight line to assist the fixture of the socket against the substrate.

BRIEF DESCRIPTION OF THE DRAWINGS

The above aspects and features of the present invention will be more apparent by describing non-limiting, illustrative embodiments of the present invention with reference to the accompanying drawings, in which.

DETAILED DESCRIPTION OF NON-LIMITING, EXEMPLARY EMBODIMENTS OF THE PRESENT INVENTION

Figure 2A:
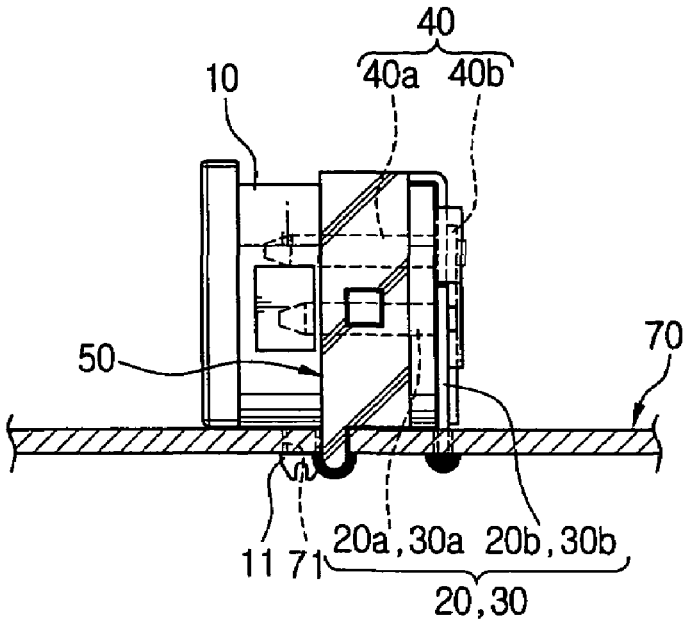
FIG. 2A and FIG. 2B are side and rear views for showing a power inlet socket according to a non-limiting embodiment of the present invention.
Figure 2B:
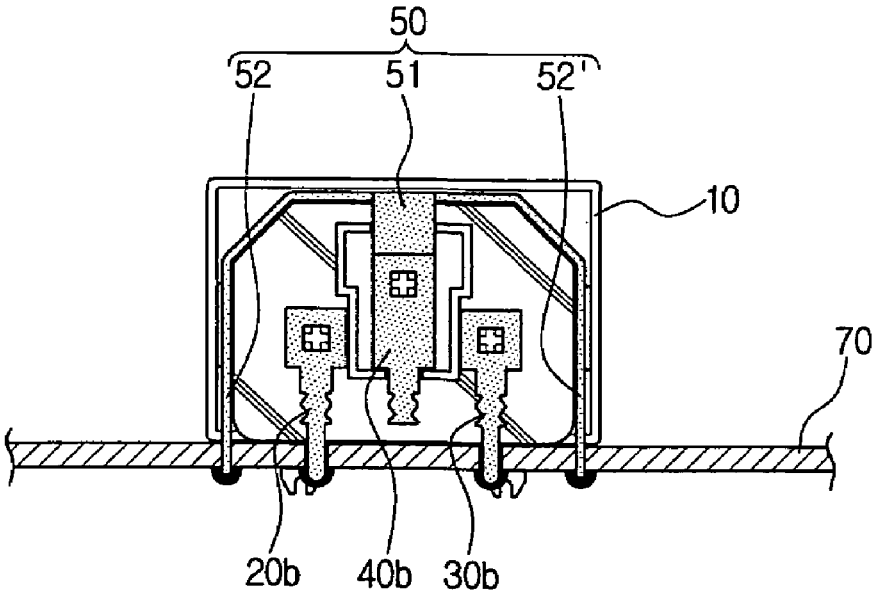
Figure 3:
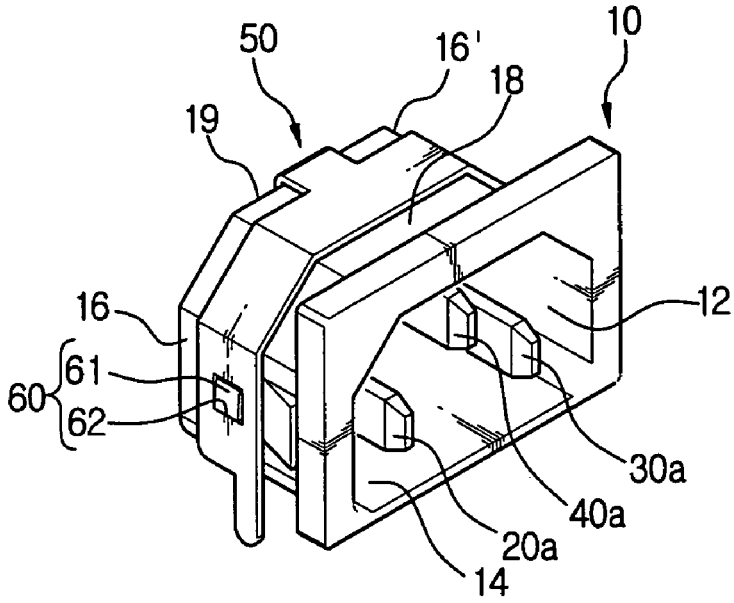
FIG. 3 is a perspective view for showing the power inlet socket of FIG. 2A and FIG. 2B according to an embodiment of the present invention.

Hereinafter, illustrative embodiments of the present invention will be described with reference to the accompanying drawings. As shown in FIG. 2A, FIG. 2B, and FIG. 3, a power inlet socket has a socket body 10, a live terminal 20, a neutral terminal 30, a ground terminal 40, and a ground member 50.

The socket body 10 has a cavity 12 formed therein, defined by a bottom wall 14 in contact with a substrate 70, two opposite side walls 16 and 16', a top wall 18, and a rear wall 19, and is open at one side thereof in order for a power plug to be externally inserted thereto. Further, the socket body 10 is preferably, but not necessarily, mounted on the substrate 70 by a pair of fixture hooks 11 that are hook-coupled into a pair of hook openings 71 formed in the substrate 70. The pair of fixture hooks 11 is formed in a middle portion of the surface of the bottom wall. Such a socket body 10 is preferably, but not necessarily, formed in a plastic mold.

A live terminal 20 and a neutral terminal 30 are press-fit at a certain distance from each other into the socket body 10 through openings formed in the rear wall of the socket body 10. These terminals 20 and 30 consist, respectively, of first pins 20*a* and 30*a* connected with the power plug in the cavity of the socket body 10 and second pins 20*b* and 30*b* connected vertically, for example, to the first pins 20*a* and 30*a* and disposed on the rear wall of the socket body 10. The ends of the second pins 20*b* and 30*b* are protruded by a predetermined height below the bottom wall of the socket body 10, and the protrusions are soldered on the substrate 70 to form electrical contact with patterns of the substrate 70.

Figure 1A:
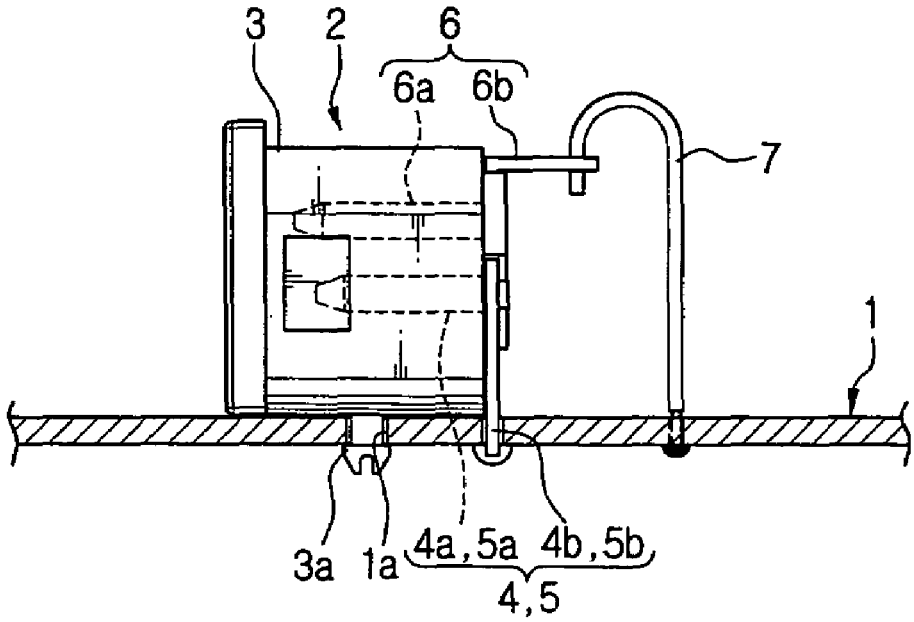
FIG. 1A (PRIOR ART)
FIG. 1A and FIG. 1B are side and rear views for showing a general power inlet socket.
Figure 1B:
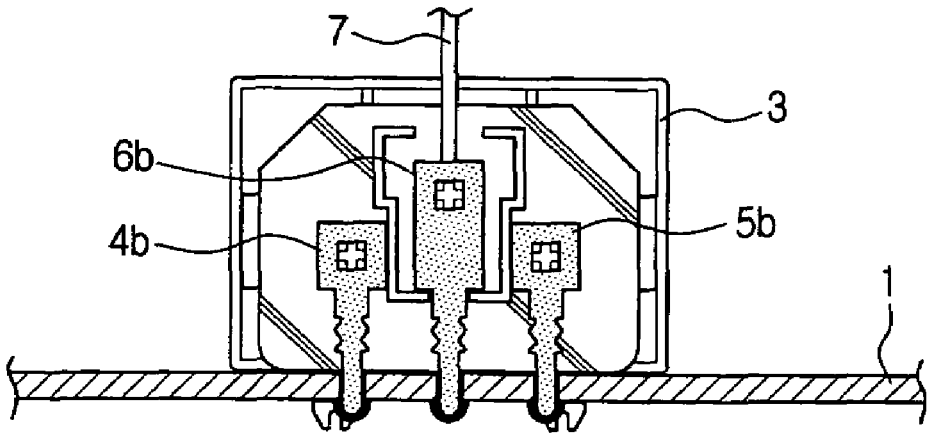
FIG. 1B (PRIOR ART)

A ground terminal 40 is mounted on the socket body 10 in a manner similar to the live terminal 20 and the neutral terminal 30, and disposed between the live terminal 20 and the neutral terminal 30 of the socket body 10. Further, as in the structure of the live and neutral terminals 20 and 30, the ground terminal 40 has a first pin 40*a* connected with the power plug in the cavity of the socket body 10 and a second pin 40*b* connected vertically, for example, to the first pin 40*a* and disposed on the rear wall of the socket body 10. However, the end of the second pin 40*b* of the ground terminal 40 does not protrude out from the bottom wall of the socket body 10 in the same manner as the conventional socket. In particular, the end portion of the conventional ground terminal 6 (refer to FIG. 1*b*) is soldered on the substrate, but the ground terminal 40 of the present invention is not soldered on the substrate 70, as shown in FIG. 2B. Accordingly, space can be secured between the live terminal 20 and the neutral terminal 30, which is advantageous for designing patterns for the terminals on the substrate 70.

The ground member 50 has one end portion 51 connected to the ground terminal 40 and the other end portions 52 and 52' forked in two branches from the end portion 51 and extended to surround the top wall and the two opposite side walls of the socket body 10, and the lower portions of the other end portions 52 and 52' are soldered on the substrate 70 to electrically connect with the ground patterns on the substrate 70. The ground member 50 is formed of a metal substance, and soldered or attached together with the live terminal 20 and the neutral terminal 30 by being connect to the substrate 70, when the socket is mounted on the substrate 70. That is, in the prior art, the socket is soldered on the substrate, and then additional wire harness work is required for the ground wire. However, the present invention can form a structure for the ground through one step of mounting the socket on the substrate.

The power inlet socket according to the present invention can pass, when currents flow into the ground terminal 40 through a power plug or upon testing, the currents to a shield part of an electric device or appliance through the ground member 50, scatter the flow of induced overcurrents into both opposite sides, and effectively lead the flow of overcurrents since the ground member 50 is formed of a metal substance.

Figure 3A:
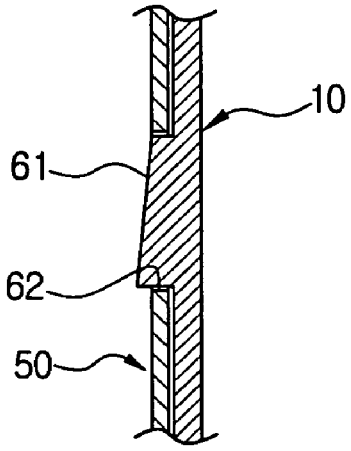
FIG. 3A is an enlarged sectional view showing a non-limiting aspect of the invention.

The power inlet socket according to one embodiment of the present invention has support parts 60 for fixing the ground member 50 to the socket body 10. The ground member support parts 60 can each consist of a support block 61 formed on opposite sides of the socket body 10 to have a certain height and a support opening 62 formed on the ground member 50 corresponding to the support block 61. Preferably, but not necessarily, the support block 61 is outwardly slanted from the upper side to the lower side in the socket-mounted direction, as shown in FIG. 3A.

Figure 4:
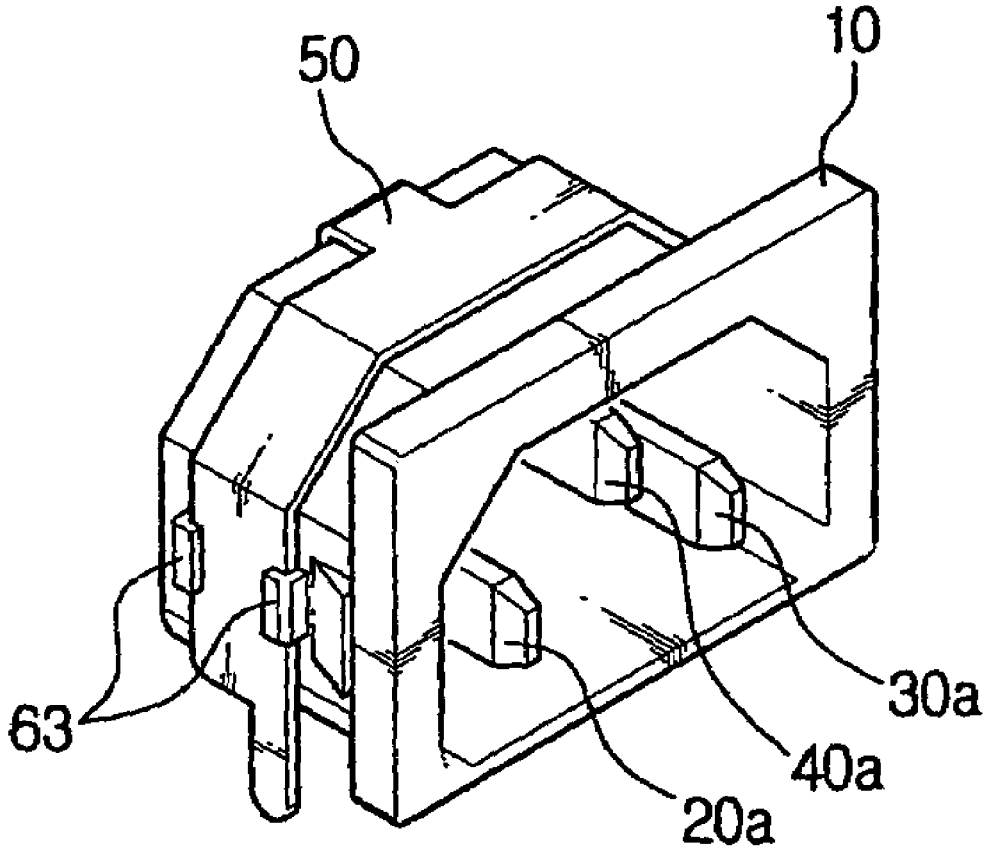
FIG. 4 is a perspective view for showing a power inlet socket according to another non-limiting embodiment of the present invention.

FIG. 4 is a perspective view for showing a power inlet socket according to another non-liming, illustrative embodiment of the present invention. As shown in FIG. 4, the socket has substantially the same structure as the aforementioned socket of the present invention. However, the power inlet socket according to the further embodiment of the present invention has a ground member support part different from the support part mentioned above.

That is, the ground member support part of the power inlet socket has support ribs 63 formed opposite to each other on each of opposite sides of the socket body 10. The support ribs 63 are each formed in a "ㄴ" shape, by which certain rails are established on opposite sides of the socket body 10 and the ground member 50 is accommodated in the rails so as to not escape from the socket body 10.

As described above, the power inlet socket according to the present invention has the ground member 50 formed to surround the outer periphery of the socket body 10, and is soldered or attached together through the substrate 70 with the live terminal 20 and the neutral terminal 30 on the substrate 70 at the opposite sides of the socket body 10, so that the assembly process becomes simplified compared to the conventional socket using the ground wire.

Further, since the power inlet socket according to the present invention has the ground member 50 nearly incorporated with the socket body 10, no interference occurs between the ground member 50 and the other parts on the substrate 70.

Further, in the power inlet socket according to the present invention, the ground terminal 40 located between the live terminal 20 and the neutral terminal 30 is not directly soldered on the substrate 70, so that additional space can be secured between the live terminal 20 and the neutral terminal 30. Accordingly, a big advantage is brought out in designing the patterns for the terminals on the substrate 70.

Further, in the power inlet socket according to the present invention, the live terminal 20 and the neutral terminal 30 are soldered on the substrate 70 at the position of the rear wall of the socket body 10, and both ends of the ground member 50 are soldered on the substrate 70 at a middle portion of the socket body 10, that is, for example, at a portion near where the fixture hooks 11 of the socket body 10 exist, by which the socket can be strongly fixed to the substrate.

That is, the present invention can provide a power inlet socket simplified in structure and excellent in assembly with satisfying the ground continuity test conditions under the more strictly enacted standard, as well as providing high reliability at a low cost.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A power inlet socket mounted on a substrate for a power supply device to connect to a power plug, comprising:

a socket body which accommodates the power plug;

a live terminal provided on the socket body, the live terminal having a first pin connected to the power plug and a second pin attached to the substrate;

a neutral terminal provided on the socket body, the neutral terminal having a first pin connected to the power plug and a second pin attached to the substrate;

a ground terminal provided between the live terminal and the neutral terminal; and a ground member connected to the ground terminal and attached to the substrate at opposite sides of the socket body.

2. The power inlet socket as claimed in claim 1, wherein the substrate is for a power supply device of a household information appliance.

3. The power inlet socket as claimed in claim 1, wherein a distance between points where the ground member contacts the substrate is greater than a distance between points where the second pin of the live terminal and second pin of the neutral terminal contact the substrate.

4. The power inlet socket as claimed in claim 1, wherein the second pin of the live terminal, the second pin of the neutral terminal and the ground member are attached to the substrate by solder.

5. The power inlet socket as claimed in claim 1, wherein the socket body has a side opening, bottom wall, opposite side walls, a top wall, and a rear wall, which define a cavity, and the ground member is connected to the ground terminal at the rear wall and is forked to surround the upper wall and the opposite side walls.

6. The power inlet socket as claimed in claim 5, wherein the ground terminal has a first pin connected to the power plug in the cavity of the socket body and a second pin disposed on the rear wall of the socket body to be connected vertically to the first pin, and the second pin does not protrude below the bottom wall of the socket body and is not directly attached to the substrate.

7. The power inlet socket as claimed in claim 5, wherein the ground member is attached to the substrate at a position between the side opening and the rear wall.

8. The power inlet socket as claimed in claim 5, wherein the ground member is forked so as to branch from an area where the ground member is connected to the ground terminal.

9. The power inlet socket as claimed in claim 5, wherein a portion of the opposite side walls are respectively slanted toward the top wall.

10. A power inlet socket mounted on a substrate for a power supply device to connect to a power plug, comprising:

a socket body having a side opening, bottom wall, opposite side walls, a top wall, and a rear wall, which define a cavity to accommodate the power plug;

live and neutral terminals each having a first pin disposed to connect to the power plug in the cavity of the socket body and a second pin disposed at the rear wall of the socket body, connected vertically to the first pin, and attached to the substrate;

a ground terminal disposed between the live terminal and the neutral terminal of the socket body;

a ground member connected to the ground terminal on the rear wall of the socket body, extended to surround the top wall and opposite side walls of the socket body, and having end portions thereof attached to the substrate; and support parts for fixing the ground member at the opposite side walls of the socket body.

11. The power inlet socket as claimed in claim 10, wherein the ground terminal has a first pin connected to the power plug in the cavity of the socket body and a second pin disposed on the rear wall of the socket body to be connected vertically to the first pin, and the second pin does not protrude below the bottom wall of the socket body and is not directly attached to the substrate.

12. The power inlet socket as claimed in claim 10, wherein the support parts each have a pair of support ribs to form rails and are disposed at the opposite side walls of the socket body, and the ground member is accommodated in and supported by the rails.

13. The power inlet socket as claimed in claim 10, wherein a pair of fixture hooks is formed at a distance from each other in a middle portion of the bottom wall of the socket body, and a pair of hook openings is formed on the substrate, which couple with the fixture hooks.

14. The power inlet socket as claimed in claim 10, wherein the substrate is for a power supply device of a household information appliance.

15. The power inlet socket as claimed in claim 10, wherein the ground member is attached to the substrate at a position between the side opening and the rear wall.

16. The power inlet socket as claimed in claim 10, wherein a distance between points where the ground member contacts the substrate is greater than the distance between points where the second pin of the live terminal and second pin of the neutral terminal contact the substrate.

17. The power inlet socket as claimed in claim 10, wherein the second pin of the live terminal, the second pin of the neutral terminal and the ground member are attached to the substrate by solder.

18. The power inlet socket as claimed in claim 10, wherein the ground member is forked so as to branch from an area where the ground member is connected to the ground terminal.

19. The power inlet socket as claimed in claim 10, wherein a portion of the opposite side walls are respectively slanted toward the top wall.

20. The power inlet socket as claimed in claim 10, wherein the support parts each have a support block formed at the opposite side walls of the socket body and a support opening formed in the ground member to correspond to the support block.

21. The power inlet socket as claimed in claim 20, wherein the support block is outwardly slanted from an upper side to a lower side in a socket-mounting direction.

* * * * *